US005823245A

United States Patent [19]

Wolf

[11] Patent Number: 5,823,245

[45] Date of Patent: Oct. 20, 1998

[54] STRAND CASTING PROCESS

[75] Inventor: Manfred Wolf, Zurich, Switzerland

[73] Assignee: Clecim, Cergy-Pontoise, France

[21] Appl. No.: 725,660

[22] Filed: Oct. 1, 1996

Related U.S. Application Data

[63] Continuation of Ser. No. 318,512, Sep. 28, 1994, abandoned, which is a continuation-in-part of Ser. No. 36,240, Mar. 24, 1993, abandoned.

[30] Foreign Application Priority Data

Mar. 31, 1992 [FR] France ..... 92 03906

[51] Int. Cl.[6] ..... B22D 11/04; B22D 11/07; B22D 11/16

[52] U.S. Cl. ..... 164/452; 164/454; 164/472; 164/478

[58] Field of Search ..... 164/452, 454, 164/451, 472, 473, 478, 154.1, 416

[56] References Cited

U.S. PATENT DOCUMENTS

| | | | |
|---|---|---|---|
| 4,438,803 | 3/1984 | Takeuchi et al. | 164/472 |
| 4,482,003 | 11/1984 | Nakano et al. | 164/452 |
| 4,544,017 | 10/1985 | Lansdown | 164/478 X |

FOREIGN PATENT DOCUMENTS

| | | | |
|---|---|---|---|
| 0 325 931 | 8/1989 | European Pat. Off. . | |
| 56-11172 | 2/1981 | Japan | 164/452 |
| 56-131048 | 10/1981 | Japan | 164/472 |
| 57-202952 | 12/1982 | Japan | 164/154 |
| 61-20653 | 1/1986 | Japan | 164/452 |
| 61-162256 | 7/1986 | Japan | 164/451 |
| 2-197359 | 8/1990 | Japan | 164/478 |

OTHER PUBLICATIONS

Abstract of Japanese Appln. JP890261046 Published May 27, 1991.

Abstract of Japanese Appln. JP890210165 Published Apr. 3, 1991.

Abstract of Japanese Appln. 58053354 Published Mar. 29, 1983.

*Primary Examiner*—J. Reed Batten, Jr.

[57] ABSTRACT

A process for strand casting of steel in a cooled casting mold made to oscillate over a distance h at a frequency f, for manufacturing a product withdrawn from the mold at a casting speed $V_C$, the metal being surmounted by alubrication product forming a liquid slag, the speed of descent of the casting mold being greater than the casting speed $V_C$ during a negative stripping time $t_N$. The casting speed VC can be adjusted over a wide range to adapt to well-defined casting conditions without modifying the nature of the lubrication product, by acting in a combined way on the distance and frequency of oscillations according to the chosen casting speed, in such a way that the consumption rate Q of the lubrication product and the negative stripping time $t_N$ are both maintained at an optimum value that remains substantially constant over the entire speed adjustment range, irrespective of the casting speed $V_C$.

15 Claims, 2 Drawing Sheets

STRAND CASTING PROCESS

This application is a continuation of U.S. Pat. application Ser. No. 08/318,512, filed Sep. 28, 1994 which in turn is a continuation of U.S. Pat. application Ser. No. 08/36,240 filed Mar. 24, 1993, both now abandoned.

FIELD OF THE INVENTION

This invention relates to a process for casting a molten metal which, allows the casting speed to be varied.

BACKGROUND OF THE INVENTION

The strand casting technique for a ferrous metal, used to obtain a product such as a billet, bloom or slab, has been employed for many years. A strand casting installation generally comprises a casting mold or shell, made up of a bottomless mold delimiting a cavity open at its two ends, the walls of which are vigorously cooled in such a way that, when molten metal is poured into the upper orifice of the mold, a solidified crust forms along the sides of the cooled walls, sufficiently thick at the lower orifice to allow continuous withdrawal of a product delimited by the solidified crust, the central part of which, being still in the liquid state, then progressively solidifies in a device providing secondary cooling located below the casting mold, this secondary cooling device also being fitted with means such as rolls for withdrawing the product, the rolls being driven in rotation and pulling the product downwards at an adjustable speed determined according to the casting conditions.

In general, the axis of the casting mold is substantially vertical, the secondary cooling device, which forms a guide jacket for the product, being curved so that the vertically cast product emerges horizontally, thereby enhancing the withdrawal of the product and its shearing into sections of a predetermined length. The axis of the casting mold is in general curved to match that of the guide jacket, thereby enhancing the change in direction of the product.

The metal must not be allowed to adhere to the cooled walls of the casting mold since this can tear and perforate the hard crust.

For this reason it was suggested, from the outset of the development of strand casting, that the casting mold should be made to oscillate along its straight or curved axis. This is achieved by using various well known devices. Generally, the casting mold is fixed in removable fashion to a table that is guided and subjected to oscillation movements by, for example, levers connected to an oscillation system. This oscillation system can be, for example, an eccentric system designed to transmit a sinusoidal type movement to the casting mold. More recently, other types of oscillation system have been proposed, for example, hydraulically controlled systems which give a much wider range of oscillation movement adjustment possibilities and allow, for example, square, saw-tooth or other kinds of speed diagram to be produced.

However, to prevent the solidified crust from adhering to the cooled walls, the walls must be lubricated with a product that is able to interpose itself between the crust and the wall, promote stripping and improve surface quality.

Powder products have been used as a lubricant for some time. They are poured onto the meniscus formed by the liquid metal in the upper part of the casting mold and melt on contact with the metal. It is advantageous to use products which, in addition to their lubrication performance, can also ensure the functions of a slag, such as absorbing inclusions.

The liquid slag thus formed on contact with the metal meniscus runs down the cooled walls of the casting mold and forms a thin film between the wall and the solidified crust.

Cyclical oscillation of the casting mold makes it easier for the slag to run down the walls of the mold. Each cycle of this oscillating movement comprises two phases: a first phase during which the mold is moved downwards, and a second phase in which the mold is moved upwards, in the direction opposite to the product, which continues to fall. It has been known for a long time that the oscillation movement of the casting mold must be adjusted in such a way that the speed of the casting mold at the end of its downward movement is greater than the product withdrawal speed, thereby allowing a negative stripping effect to be created during a certain period of time called "negative stripping time". During this negative stripping time, observation has shown that the liquid slag interposed between the cooled wall and the solidified crust is in fact compressed and then decompresses, which favors infiltration of the lubricant.

This results, however, in the formation of ripples or oscillation marks on the faces of the cast product, the depth of which depends not only on the nature of the metal but also on the casting conditions and, in particular, on the distance and frequency of the oscillations as well as the negative stripping time.

Moreover, the quality of lubrication obtained depends also on the nature of the slag, particularly its viscosity, the dimensions of the cast product and the withdrawal speed.

In order to improve the surface quality of the cast product, it is desirable to minimize as much as possible the depth of the oscillation ripples. A large number of parameters dependent, in particular, on the nature of the metal and the casting conditions can be adjusted to achieve this end.

It is acknowledged, however, that the negative stripping time must be reduced. This is achieved by using a combination of fairly high frequencies and a reduced distance, which also has the effect of minimizing inertia and the risk of vibration of the oscillation mechanism. This, however, reduces the infiltration of the lubricant, thereby increasing the danger of sticking.

For each type of metal, it is possible to determine, at least empirically, the nature of the slag, particularly its viscosity and optimum consumption, that will provide good lubrication of the casting mold for a normal withdrawal speed and up to the maximum speed desired.

However, the withdrawal speed of the product cannot be kept constant or even within a narrow range. Indeed, this speed already depends on the transverse cross-sectional area of the product, the casting speed for products with small cross-sectional areas such as billets being greater than the casting speed for products of larger cross-sectional areas such as blooms and slabs, possibly in the range of two to three times faster.

Moreover, in modern installations, it may be necessary to vary the withdrawal speed of a given product quite considerably. For example, molten metal is usually brought to the steel-mills in ladles which are placed in sequence above the installation, an empty ladle being replaced by a full ladle. To avoid breaks in the casting process while a ladle is being replaced, the steel is not poured directly into the casting mold but into an intermediary tank which acts as a buffer and which may also distribute the steel into a number of adjacent lines. However, any delay in replacing an empty ladle may exceed the capacity of the intermediary tank which, as a result, would make it necessary to reduce the rate at which metal is poured into the mold and consequently the withdrawal speed.

However, if the withdrawal speed is varied, it is necessary to maintain correct lubrication of the walls and retain an optimum negative stripping rate. This can be achieved by acting on the amplitude and/or frequency of the oscillations according to the casting speed. However, in conventional machines subjected to eccentric oscillation, the amplitude of the oscillations is generally difficult to adjust, and it can only be adjusted when the machine is switched off. In practice, the customary procedure for adapting the speed of the mold to the casting speed is to act only on the oscillation frequency.

In most cases, the frequency is simply a linear function of casting speed. The attached figure, for example, shows variations in frequency as a function of casting speed, and allows the oscillation frequency to be determined for each speed, the oscillation distance being maintained constant over the entire speed adjustment range. In the example shown, corresponding to a typical case, the constant oscillation distance is 6.5 millimeters, the frequency being linearly linked to the speed by the relationship $f=100\ V_c$.

The average speed of the casting mold during a cycle is $V_m=2hf$, the value of the stripping ratio, widely referred to as the "NSR", and equal to $V_m/V_c=2hf/V_c$, is therefore 1.3 for a distance of 6.5 millimeters, corresponding to a case frequently found in industry.

It is also known that, for a sinusoidal casting mold movement, the negative stripping time is:

$$t_N = \frac{60}{\Pi f} \cdot \text{Arc cos} \frac{Vc}{\Pi fh}$$

The diagram in FIG. 1*b* shows the variation in negative stripping time $t_N$ as a function of given values of casting speed and takes account of the corresponding frequency shown in FIG. 1*a*. It can be seen that, for relatively high casting speeds above 1 meter per minute, the negative stripping time is fairly low, in the region of 0.1 second, which allows the depth of the oscillation ripples to be minimized, particularly in the case of steel grades characterized by a "ferritic potential" in the region of 1, which are prone to deep rippling and consequently present a risk of transverse cracking.

It can be seen, however, that low $t_N$ values correspond to high frequencies, which increases the danger of sticking by reducing the infiltration of the lubricant, with an increasing tendency to stick at high casting speeds. Consequently, the viscosity of the slag has to be adapted to the casting speed.

For this reason in the example shown in FIGS. 1*a* and 1*b*, a powder is advantageously used which through fusion forms a slag whose viscosity at 1300° C. is: $\eta_1=1.5$ poise.

As revealed in the diagram, it now becomes possible to cast small-dimension products in good conditions, for example, 150 by 150 millimeter billets at speeds ranging from 1.2 to 1.8 meters per minute.

In contrast, for lower speeds, it will be necessary to use another powder which, at 1300° C., will provide a slag of viscosity $\eta'_1=6.0$ poises. This makes it possible to cast products of relatively large dimensions, such as 240 by 240 millimeter blooms, at speeds ranging from 0.4 to 0.8 meter per minute. However, the diagram reveals that the stripping time can then vary from approximately 0.25 to 0.5 second Such a result is not therefore entirely satisfactory even though it was obtained by varying the quantity of slag for two speed ranges, which, in addition, are also fairly limited.

The object of the invention is therefore to overcome such drawbacks thanks to a new strand casting process which allows the casting speed to be varied across a much larger range with the same slag.

SUMMARY OF THE INVENTION

In accordance with the invention, the nature and optimum consumption rate of the lubrication product is first of all determined according to the nature of the metal and normal casting conditions and then, without altering the nature of the lubrication product, the casting speed $V_c$ is adjusted over a wide range to adapt to well-defined casting conditions while acting in a combined way on the distance and frequency of oscillation according to the chosen casting speed, in such a way that for each casting speed $V_c$, the value of the lubrication product consumption rate Q and that of the negative stripping time $t_N$ do not substantially deviate from an optimum value valid over the entire speed adjustment range.

In accordance with one embodiment of the invention, the distance and frequency of oscillation are adjusted differently over two speed ranges covering the wide adjustment range desired, respectively a high speed range descending from the maximum casting speed to the critical speed V' and within which the oscillation distance is maintained constant whereas the oscillation frequency is an increasing function of the casting speed, and a low speed range which extends from the critical speed to a minimum speed and in which the oscillation frequency is maintained substantially constant whereas the oscillation distance is an inverse function of the casting speed, the critical speed being the speed down to which it is possible to descend while maintaining the oscillation distance constant and retaining an acceptable stripping ratio $V_m/V_c$, where $V_c$ is the casting speed at a considered point in time and $V_m$ the average speed of the casting mold during the cycle corresponding to this point in time.

Preferably, the amplitude of the oscillations in the low speed range is an inverse linear function of the casting speed, and the oscillation frequency in the high speed range is a direct linear function of the casting speed.

In accordance with a further embodiment of the invention, over a range of adjustment of the casting speed $V_c$, possibly extending from 0.3 meter per minute to approximately 7 meters per minute or more, oscillation distance and frequency are linked to the nature and rate of consumption of the lubrication product by the equation:

$$Q=A(h\cdot f\cdot V_c\cdot \eta)^{-m}$$

where:

Q is the slag consumption rate in kilograms per square meter of cross-sectional area of the casting mold, h the distance of oscillation in meters, f the oscillation frequency in number of cycles per minute (cpm), $V_c$ the casting speed in meters per minute, $\eta$ the slag viscosity in poises at approximately 1300° C., A a constant, m a number between 0 and 1.

In a particularly advantageous manner, the values of constants A and m in the above equation are in the region of 0.5.

In accordance with a further embodiment the oscillation distance in the low speed range is linked to the casting speed $V_c$ by the equation:

$$h=-DV_c^a+C$$

where D, C and a are constant values dependent on the nature of the metal and casting conditions.

It is also preferable that the oscillation frequency in the high speed range be adjusted according to casting speed $V_c$ so as to always remain above a minimum frequency f'=680 $V_c$/2h.

In a preferred embodiment of the invention, the casting mold is oscillated by triangular oscillations and the negative stripping time $t_N$ is maintained at a constant optimum value over the whole range of adjustment of the casting speed.

Preferably, the lubrication product consumption rate is maintained at a substantially constant value in the region of 0.3 kilogram per square meter of cross-sectional area of the casting mold across the whole range of adjustment of the casting speed.

In a particularly advantageous embodiment relating to a strand casting installation for the implementation of the process in accordance with the invention, the casting mold is associated with force measuring sensors which emit a signal that is used to optimize parameters in real time in a closed, self-regulating control loop.

BRIEF DESCRIPTION OF THE DRAWINGS

The invention will be better understood from the following description of a practical example illustrated by the attached drawings.

As mentioned above, the diagrams in Figures 1*a* and 1*b* illustrate examples pertaining to conventional casting, and show, respectively, as a function of casting speed, oscillation distance and frequency in Figure 1*a*, and negative stripping time and slag consumption rate in FIG. 1*b*.

DETAILED DESCRIPTION

After evaluating a large number of industrial evaluations, the following approximate empirical function was established between the lubrication product consumption Q expressed in kilograms per square meter of transverse cross-sectional area and the main casting parameters:

$$Q=A(h\cdot f\cdot V_c\cdot \eta)^{-m}$$

where h is oscillation distance in meters, f frequency in cycles per minute, $V_c$ casting speed in meters per minute and η viscosity in poises at 1300° C.

The temperature 1300° C. is the characteristic surface temperature of mild steel, i.e. approximately 200° C. below solidus. For more alloyed grades, the viscosity value would have to be adapted to a lower characteristic temperature.

This function is essentially empirical but it has been shown that it could in practice be applied to the following range of different parameters:

h between 0.002 and 0.020 meter, f between 20 and 400 cpm and, preferably, 25 to 200 cpm, $V_c$ between 0.3 and 7.0 meters per minute, η between 0.1 and 20 poises.

In the most conventional cases, constants A and m are in the region of 0.5.

Figure 1A:
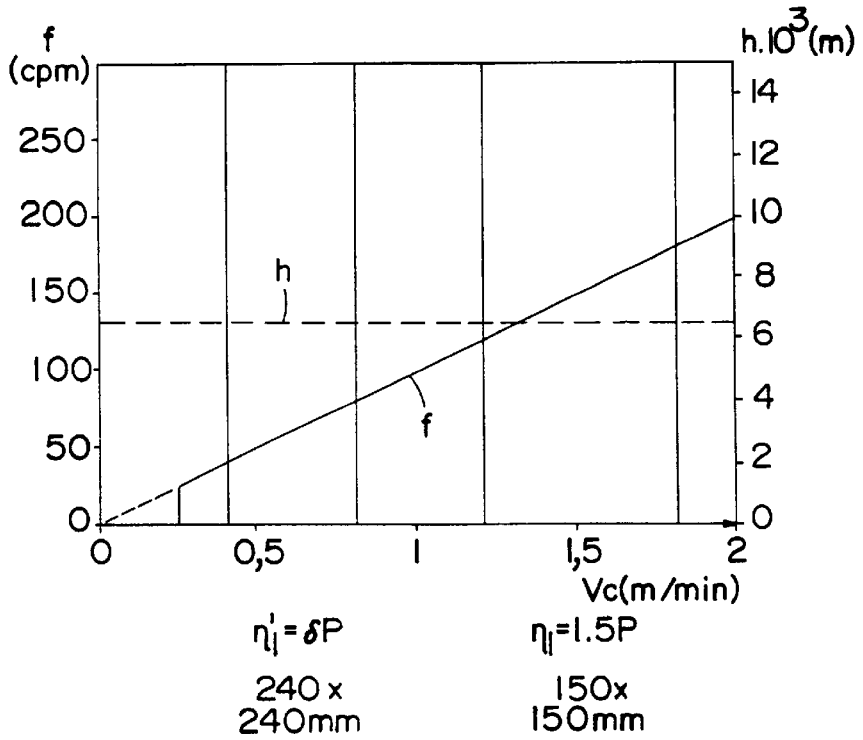
Figure 1B:
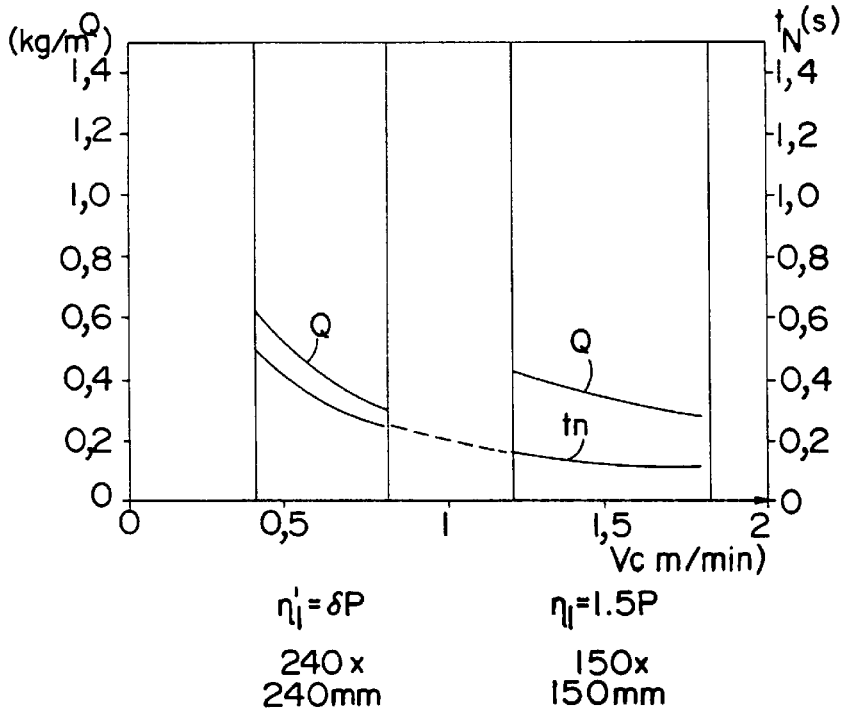

Figure 1*b*, as already seen, gives examples of conventional casting in which distance is constant, with frequency increasing linearly as a function of speed. The figure shows, first, the variation of negative stripping time $t_N$, and secondly, the values of consumption rate Q, for two kinds of slag employed, the viscosities of which are 1.5 poise for the relatively high speeds corresponding to casting 150 by 150 millimeter billets, and 6 poises for the relatively low speeds corresponding to casting 240 by 240 millimeter blooms.

The figure reveals that for casting billets at speeds in the range 1.2 to 1.8 meter per minute, the negative stripping time remains in the range of 0.1 to 0.2 second , with slag consumption varying from 0.4 to 0.3 kilogram per square meter.

It was observed that the optimum slag powder consumption value was in the region of 0.3 kilogram per square meter and the optimum negative stripping time 0.1 second for steel grades with a "ferritic potential" in the region of 1.

Surface quality can therefore be satisfactorily maintained for products with small cross-sectional area and high casting speeds, stripping time and slag consumption being close to the optimum values.

On the other hand, it can be seen that for low speeds, negative stripping time and slag consumption vary more greatly and deviate substantially from the optimum values, even when using a high viscosity slag, for example, in the region of 6 poises. There is therefore a risk of very poor surface quality at low speeds despite the use of a high viscosity slag powder.

It will be seen, in contrast, that the process in accordance with the invention provides a very wide range of operating flexibility to a strand casting installation since it allows casting speed to be adjusted over a wide range without changing the nature of the lubrication product and at the same time retaining virtually optimum values of negative stripping time and consumption of this product, even at low speeds.

Figure 2A:
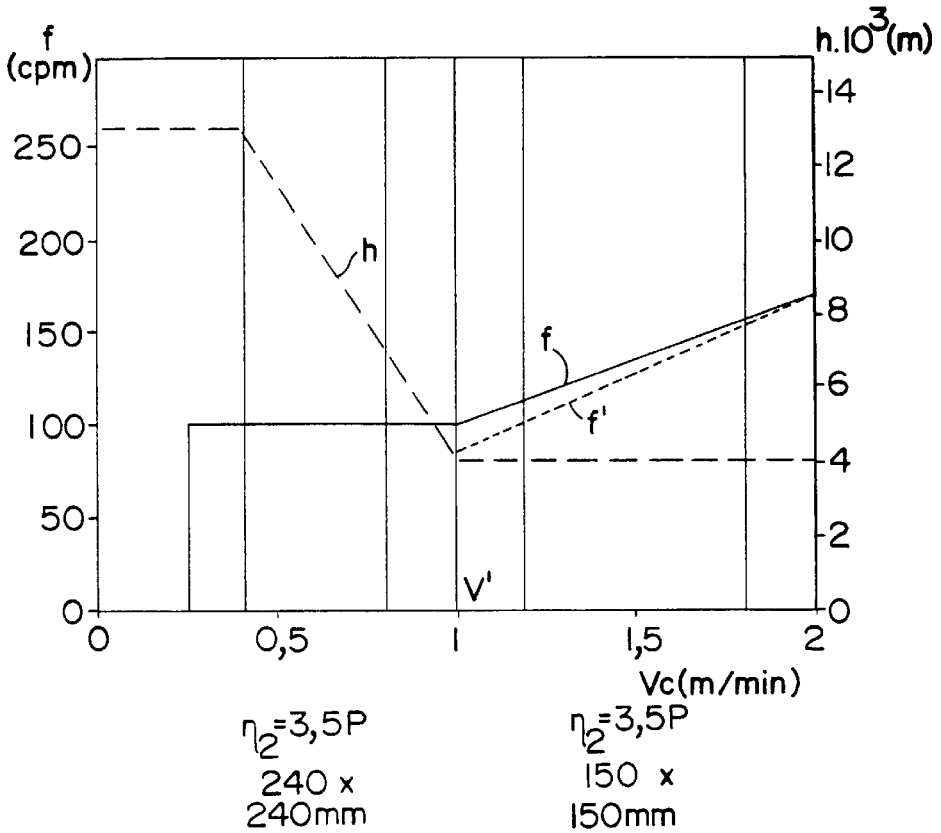
FIGS. 2*a* and 2*b* are diagrams illustrating a practical development example of the invention, and show, respectively, as a function of casting speed, the values of the oscillating distance and frequency in FIG. 2*a*, and the values of negative stripping time and slag consumption rate in FIG. 2*b*.

In FIG. 2*a*, variations in oscillation distance h and oscillation frequency f are shown as a function of the chosen casting speed, which in the example shown can be varied from 0.3 to 2 meters per minute.

The viscosity of the slag chosen in the example is $\eta_2$=3.5 poises.

In a first high speed range, the oscillation distance is maintained, as before, at a constant value, for example, 4 millimeters. The frequency however is modified linearly according to speed according to the equation:

$$f=70V_c+30.$$

For such an oscillation distance, this frequency variation law supplies an "NSR" ratio of 0.68 for a maximum casting speed of 2 meters per minute, which makes it possible to ensure the negative stripping required for correct action of the lubricant, it being possible to monitor this action by sensors such as balances or control gauges which indicate the forces applied to the casting mold.

As shown in FIG. 2*a*, oscillation frequency is a direct function of speed and therefore increases with speed. However, in the chosen variation law, the frequency always remains higher than the value that gives a minimum "NSR" ratio of 0.68, the straight line representing variations in frequency f being above the straight line f' represented by dots and which corresponds to the equation f=680$V_c$/2h.

The oscillation frequency can in general be adjusted over a wide range from, for example, 20 to 400 cycles per minute. However, it is preferable not to exceed 200 cpm in order to improve the operating life of the oscillation system.

In accordance with one embodiment of the invention, it is possible to reduce casting speed while retaining a constant oscillation distance and proportionally lowering the frequency relative to the speed, over a whole range of high speeds extending from the maximum speed to a critical speed V', which is the speed to which it is possible to descend while maintaining a constant oscillation distance and retaining an acceptable NSR ratio, $V_m/V_c$, which, in the case shown of 0.68, corresponds to a critical speed V' in the region of 1 meter per minute.

On the other hand, if it is desired to move down into a speed range lower than critical speed V', the oscillation frequency is maintained at a constant value corresponding to the critical speed V', this being in the order of 100 cycles per minute, and then the oscillation distance h adjusted according to an inverse linear function of the speed, which signifies that the oscillation distance h increases proportionally to any reduction in casting speed $V_c$.

The oscillation distance h is preferably linked in the low range to the casting speed $V_c$ by an equation in the form:

$$h=\pm DV_c^a+C$$

where D, C and a are constant values dependent on the composition of the metal and casting conditions.

In the casting example shown in FIG. 2*a*, it was seen that h is a linear function of $V_c$, a therefore being equal to 1.

It follows therefore that a single slag with a viscosity of 3.5 poises could be used to cast products of different cross-sectional areas in two speed ranges, respectively 150 by 150 millimeter billets in a speed range from 1.2 to 1.8 meter per minute and 240 by 240 millimeter blooms in a speed range from 0.4 to 0.8 meter per minute.

This allows us to compare the advantages provided by the invention relative to the conventional example shown in FIGS. 1*a* and 1*b*.

As already mentioned, one important advantage is that it is possible to use a single medium viscosity slag, whereas in the preceding case it was necessary to use a low viscosity slag for billets and a high viscosity slag for blooms. This advantage is particularly important when it is desired to vary the cross-sectional area of the cast product since changing slag while casting is in progress is very difficult.

Moreover, the curve representing variation in negative stripping time $t_N$ shown in FIG. 2*b* reveals that time $t_N$ remains below the optimum value 0.1 second over the whole of the high speed range, and that if time $t_N$ reaches higher values for the low speeds, these values nevertheless remain in the region of 0.25 second, which is very acceptable and substantially lower than the negative stripping time seen in FIG. 1*b*.

Figure 2B:
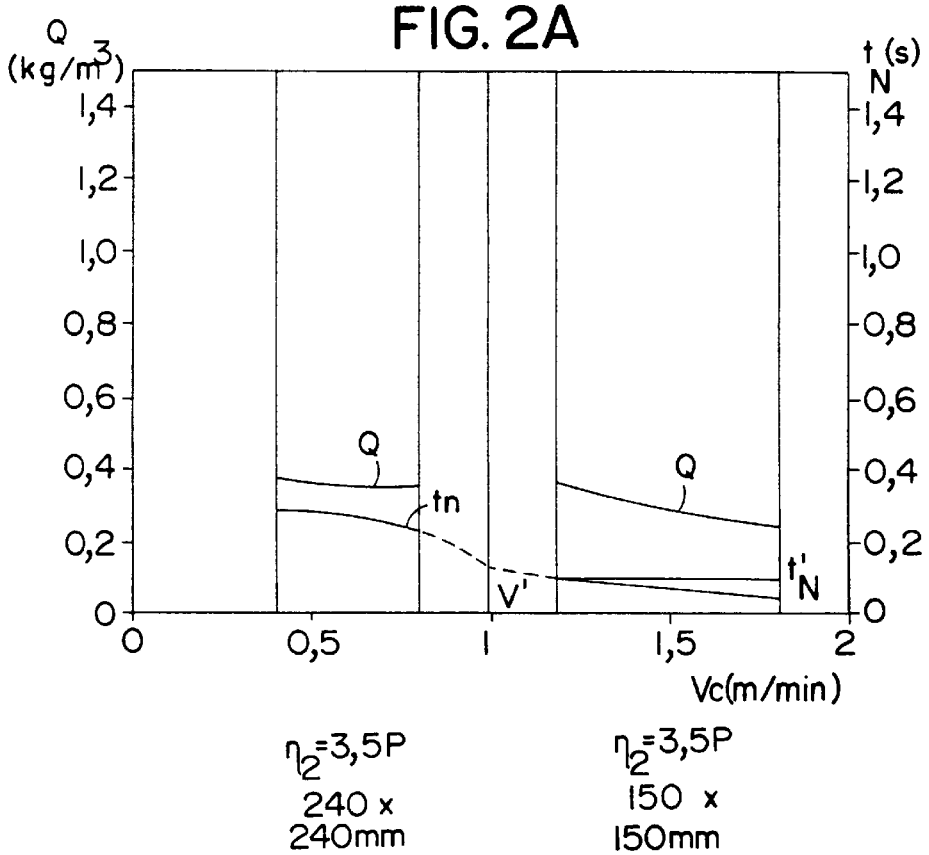

But in FIG. 2*b*, which also shows the curves representing the consumption of slag Q, it can also be seen that the curves are substantially horizontal in both cases, and that consumption Q is maintained at a virtually constant value over the whole speed range and is roughly equal to the optimum consumption figure of 0.3 kilogram per square meter. This possibility of maintaining stable consumption is also an important advantage of the invention.

It can therefore be seen that without changing the nature of the slag, the invention allows the speed to be varied across a very wide range while maintaining the values of the negative stripping time and slag consumption at values very close to their optimum values, thus allowing excellent surface quality to be obtained.

To adjust oscillation distance as a function of speed in accordance with the invention, it is advantageous to control the oscillation of the casting mold by means of a hydraulic drive system as described, for example, in French patent 86.03282 filed Mar. 7 1986 by applicant or that described in EP-A-0325.931. Such a system in fact provides a very easy means of altering the oscillation distance during casting.

Moreover, the $t_N$ curve mentioned above and shown in FIG. 2*b* corresponds to the conventional case of sinusoidal oscillations. However, use of a hydraulic oscillation control system makes it possible to easily modify the form of the speed variation diagram and obtain rectangular or triangular oscillations.

As shown in FIG. 2*b*, negative stripping time can in this case be adjusted to a constant value $t'_N$ equal to the optimum value of 0.1 second over the whole speed adjustment range.

It can be seen that this advantage is particularly significant at low speeds since it allows the negative stripping time to be reduced again to the optimum value. The use of triangular oscillations is also desirable at high speeds. In fact, in the example shown, which starts from a 100 cpm oscillation frequency for a critical speed V'=1 meter per minute, corresponding to a total cycle time of 0.6 second, the casting mold rise time, equal to $t_p=t_c-t_N$ and which is 0.5 second for the critical speed of 1 meter per minute, can be gradually reduced according to the increase in the speed and the accompanying increase in frequency according to the law $F=70V_c+30$, since $t_N$ remains equal to the optimum value 0.1 second.

Thus, over the high speed range, the rise time of the casting mold relative to the product can drop from 0.5 to 0.25 second whenever the casting speed passes from 1 to 2 meters per minute.

The oscillation parameters can be suitably adapted to the needs of the surface quality and this mode of operation reduces the vibrations and increases the life of the oscillation system.

The invention can therefore be applied, in a general way, to any strand casting installation in which oscillation distance can be adjusted during casting, and it is particularly desirable in the case of triangular oscillations since a constant and optimum negative stripping time can be obtained.

Such a casting installation will preferably be equipped with sensors for measuring the forces applied to the casting mold whose signals can be used to provide real time optimization of the parameters in a closed, self-regulating control loop.

The invention is obviously not limited to the single development example described here in detail, and depending on the nature of the steel and casting conditions, other casting speed ranges could of course be covered by using a different viscosity slag.

Moreover, although billet casting is foreseen in the high speed range and bloom casting in the low speed range, the principles of the invention can be applied to all product cross-sectional areas such as casting slabs whose cross-sectional area can be made to vary during casting.

What is claimed is:

1. Strand casting process for a molten metal in an installation for continuous production of a cast product by pouring molten metal into a bottomless mold having an axis and cooled walls, said installation comprising means for oscillating said mold along said axis over a distance and at a frequency, and means for withdrawing said product from said mold at a casting speed, oscillations of said mold being adjusted so that, during each oscillation cycle of duration tc, a speed of descent of said mold is greater than said casting speed during a negative stripping time having a first value which is valid over a first adjustment range of said casting speed, the molten metal being surmounted by a lubricant forming a liquid slag for lubricating said cooled walls of said mold, said lubricant being poured into an upper part of said mold with a consumption rate having a first value which is valid over said first adjustment range of said casting speed, said process comprising the steps of:

(a) determining the nature of said lubricant and said consumption rate having a first value, relative to the composition of molten metal and a first casting condition corresponding to said first adjustment range of said first casting speed;

(b) adjusting said casting speed over a second adjustment range to a lower casting speed adapted to a lower casting condition without modifying said lubricant; and (c) acting on both said distance h and frequency f of the oscillations according to said lower casting speed, the consumption rate of said lubricant and the negative stripping time remaining substantially at their respective first values corresponding to said first adjustment range of said casting speed.

2. Strand casting process as claimed in claim 1, wherein said distance and frequency of saidoscillations are adjusted differently over two speed ranges covering said second adjustment range, namely (i) a high speed range which extends from a maximum speed down to a speed V' within which said oscillation distance is held constant while said oscillation frequency is an increasing function of said casting speed, called critical speed, and (ii) a low speed range which extends from said critical speed down to a minimum speed and within which said oscillation frequency is held substantially constant while the amplitude of the oscillations is a decreasing function of said casting speed, said critical speed being the speed to which it is possible to descend while maintaining the amplitude of the oscillations constant and retaining an acceptable stripping ration $V_m/V_3$, $V_c$ being said casting speed at a given point in time and $V_m$ being an average speed of said casting mold during the cycle corresponding to said given point in time.

3. Strand casting process as claimed in claim 2, wherein the oscillation distance in said low speed range is an inverse linear function of said casting speed.

4. Strand casting process as claimed in claim 2, wherein the oscillation frequency in said high speed range is a direct linear function of said casting speed.

5. Strand casting process as claimed in claim 4, wherein, over a range of adjustment of said casting speed extending from 0.3 meter to at least 7.0 meters per minute, oscillation distance and frequency are linked to the nature and to the consumption rate of said lubricant by the equation:

$$Q=A(h\cdot f\cdot V_c\cdot\eta)^{-m}$$

where:

Q is the slag consumption rate in kilograms per square meter of cross-sectional area of said casting mold, h is the distance in oscillation meters, f is the oscillation frequency in number of cycles per minute (cpm), $V_c$ is said casting speed in meters per minute, $\eta$ is the slag viscosity in poises at approximately 1300° C., A is a constant, and m is a number between 0 and 1.

6. Strand casting process as claimed in claim 5, wherein the values of A and m are in the region of 0.5.

7. Strand casting process as claimed in claim 2, wherein the oscillation distance h in said low speed range is linked to said said casting speed by the equation:

$$h=+D\cdot(V_c)^a+C$$

where D, C and a are constant values dependent on the composition of the metal and the casting conditions.

8. Strand casting process as claimed in claim 2, including the step of adjusting the oscillation frequency in said first adjustment speed range according to said casting speed so as to maintain said oscillation frequency above a minimum frequency $f'=680(V_o/2h)$.

9. Strand casting process as claimed in claim 1, including the steps of oscillating the casting mold by triangular oscillations and maintaining said negative stripping time at a constant value over the whole range of adjustment of said casting speed.

10. Strand casting process as claimed in claim 1, including the step of maintaining the rate of consumption of said lubricant over the whole range of adjustment of said casting speed at a substantially constant speed in the order of 0.3 kilogram per square meter of cross-sectional area of said casting mold.

11. Strand casting process as claimed in claim 10, wherein the maximum oscillation frequency is 200 cycles per minute.

12. Strand casting process as claimed in claim 1, wherein the oscillation frequency is in the range of 20 to 400 cycles per minute.

13. Strand casting process as claimed in claim 1, wherein the negative stripping time is maintained over the whole speed adjustment range at a substantially constant value in the region of 0.1 second for steel grades with a ferritic potential in the region of 1.

14. Strand casting process as claimed in claim 1, wherein said casting mold is associated with force measuring sensors which send a signal that is used for real-time optimization of parameters in a closed self-regulating loop.

15. Strand casting process for a molten metal in an installation for continuous production of a cast product by pouring molten metal into a bottomless mold having an axis and cooled walls, and associated with means for oscillating said mold along said axis over a distance h and at a frequency f, and means for withdrawing said cast product at an adjustable casting speed, said mold having during each oscillation of duration $t_c$, a speed of descent which is greater than said casting speed during a negative stripping time $t_N$, said process comprising the steps of:

(a) pouring a lubricant into an upper part of said mold with a consumption rate Q, said lubricant forming a liquid slag for lubricating said cooled walls of said mold;

(b) varying said casting speed over a speed range comprising a high speed range and a low speed range while using the same lubricant and maintaining the consumption rate Q substantially constant across the entire said speed range;

(c) adjusting the oscillation frequency as an increasing function of the casting speed across said high speed range from a maximum speed down to a critical speed V' to which it is possible to descend while maintaining the amplitude of the oscillations constant and retaining a stripping ratio $V_m/V_c$ providing good lubrication, $V_c$ being said casting speed at a given point in time and $V_m$ being an average speed of said casting mold during the cycle corresponding to said point in time; and (d) adjusting the amplitude of the oscillation as a decreasing function of the casting speed while holding the oscillation frequency substantially constant across said low speed range from said critical speed V' down to a minimum speed.

* * * * *